US007250713B2

(12) United States Patent
Hwang

(10) Patent No.: US 7,250,713 B2
(45) Date of Patent: Jul. 31, 2007

(54) FRAME FOR CATHODE RAY TUBE HAVING A PLURALITY OF BEADS

(75) Inventor: Yong Ik Hwang, Kyungsangbuk-do (KR)

(73) Assignee: LG Philips Displays Korea Co., Ltd., Seoul (KR)

( * ) Notice: Subject to any disclaimer, the term of this patent is extended or adjusted under 35 U.S.C. 154(b) by 0 days.

(21) Appl. No.: 11/249,434

(22) Filed: Oct. 14, 2005

(65) Prior Publication Data

US 2006/0082281 A1 Apr. 20, 2006

(30) Foreign Application Priority Data

Oct. 15, 2004 (KR) ..... 10-2004-0082762

(51) Int. Cl.
*H01J 29/07* (2006.01)
*H01J 29/81* (2006.01)

(52) U.S. Cl. ..... 313/407; 313/402

(58) Field of Classification Search ..... 313/402–408
See application file for complete search history.

(56) References Cited

U.S. PATENT DOCUMENTS 4,886,997 A * 12/1989 Inoue et al. ..... 313/406
6,046,535 A * 4/2000 Jung ..... 313/402
6,215,237 B1 * 4/2001 Tsuchida et al. ..... 313/402
6,577,049 B1 * 6/2003 Kim et al. ..... 313/407
6,724,136 B1 * 4/2004 Kim et al. ..... 313/402

FOREIGN PATENT DOCUMENTS

JP 11054063 A * 2/1999
JP 11067118 A * 3/1999
KR 1999-0075045 10/1999

* cited by examiner

*Primary Examiner*—Mariceli Santiago
(74) *Attorney, Agent, or Firm*—Birch, Stewart, Kolasch & Birch, LLP

(57) ABSTRACT

A frame for a cathode ray tube including a substantially rectangular frame body having longer and shorter sides, and one or more beads formed on each of the longer frame sides, and one or more beads formed on each of the shorter frame sides, wherein at least one of the beads formed on each of the longer frame sides has a shape different from the shape of the beads formed on each of the shorter frame sides, to increase the rigidity of the longer frame side. The number of the beads formed on each of the longer frame sides may be different from the number of the beads formed on each of the shorter frame sides, to increase the rigidity of the longer frame side.

15 Claims, 8 Drawing Sheets

FRAME FOR CATHODE RAY TUBE HAVING A PLURALITY OF BEADS

BACKGROUND OF THE INVENTION

1. Field of the Invention

The present invention relates to a frame for a cathode ray tube, and, more particularly, to a frame for a cathode ray tube in which the shape of beads formed on the frame or the number of the beads is improved to increase the rigidity of longer sides of the frame.

2. Description of the Related Art

A conventional cathode ray tube will be described hereinafter with reference to FIG. 1.

FIG. 1 is a sectional view illustrating a structure of a conventional cathode ray tube. As shown in FIG. 1, the conventional cathode ray tube includes a panel 1, a funnel 2, a shadow mask 3, an electron gun 4, a deflection yoke 5, a frame 6, a spring 7, and an inner shield 8.

Operation of the cathode ray tube having the above-mentioned configuration will be described. An electron beam, which is emitted from the electron gun 4 travels toward the panel 1, and is then vertically and horizontally deflected by the deflection yoke 5, which is arranged at a neck of the funnel 2.

The deflected electron beam passes through slots formed through the shadow mask 3, and reaches a screen coated on an inner surface of the panel 1. The screen emits light, using the energy of the electron beam, so that an image is reproduced.

The frame 6, which is also included in the cathode ray tube, supports the shadow mask 3. The spring 7 is arranged to tightly fit the frame 6 with an inner surface of the panel 1.

If the electron beam is influenced by an external geomagnetic field, the travel path of the electron beam is deflected, so that the color purity of the reproduced image is degraded. The inner shield 8, which is included in the cathode ray tube, is adapted to reduce the influence of the geomagnetic field.

Meanwhile, the frame 6 must be subjected to treating processes such as a high-temperature heating process and a welding process so that the frame 6 can be used for cathode ray tubes. During the treating processes, however, a vertical load is applied to the frame 6 at one side of the frame 6, so that the frame 6 may be twisted.

Also, the cathode ray tube is subjected to a drop impact test after the manufacture thereof. However, the frame 6 may be deformed during the drop impact test where the frame 6 has a low rigidity. Where the frame 6 is deformed, the position of the shadow mask 3 varies due to the deformation of the frame 6. In this case, the electron beams cannot strike target portions of a phosphor surface, so that a degradation in the color purity of the reproduced image occurs.

Meanwhile, it is possible to reduce the weight and manufacturing costs of the cathode ray tube by reducing the thicknesses of the materials used to manufacture the cathode ray tube. However, the reduction of the thickness of the frame 6 may cause a serious problem associated with the rigidity of the frame 6.

In order to solve this problem, it is necessary to increase the rigidity of the frame 6. However, where the rigidity increase is achieved by increasing the thickness of the frame 6, there is a problem in that the weight and manufacturing cost of the cathode ray tube increase. In order to eliminate such a problem, beads may be formed on the frame 6. This method will be described in detail with reference to FIG. 2.

FIG. 2 is a perspective view illustrating a conventional frame, on which beads are formed. As shown in FIG. 2, the conventional frame, which is designated by reference numeral 6, has a substantially rectangular structure having longer sides extending along a longer axis x and shorter sides extending along a shorter axis y. The frame 6 also has a side wall 6*a* welded to a shadow mask, and a bottom wall 6*b* bent from a lower end of the side wall 6*a* substantially in perpendicular to the side wall 6*a*.

Beads 6*c* are formed on the frame 6. The beads 6*c* may have various shapes. For example, the beads 6*c* may have a substantially rectangular shape, as shown in FIG. 2.

Although the beads 6*c* may be designed to have various arrangements and shapes on the frame 6, the numbers of the beads 6*c* at the longer and shorter sides of the frame 6 are equal in general cases. Also, the shapes of the beads 6*c* at the longer and shorter sides of the frame 6 are identical or similar.

In such a case, however, there is a problem in that, when the same load is applied to both the longer and shorter sides of the frame 6, stress is concentrated on the longer sides of the frame 6 because the longer frame sides have a length relatively larger than that of the shorter frame sides. For this reason, the longer sides of the frame 6 have a structure relatively weak against temperature variation and torsion caused by a load applied to the frame 6 at one side of the frame 6. In other words, the rigidity difference between the longer and shorter sides of the frame 6 increases, so that the rigidity of the frame 6 is generally reduced.

SUMMARY OF THE INVENTION

The present invention has been made in view of the problems incurred in the above-mentioned conventional cases, and it is an object of the invention to provide a frame for a cathode ray tube in which the number of beads formed on the longer sides of the frame is different from the number of beads formed on the shorter sides of the frame, to increase the rigidity of the longer frame sides.

In accordance with one aspect, the present invention provides a frame for a cathode ray tube comprising a substantially rectangular frame body having longer and shorter sides, and one or more beads formed on each of the longer frame sides, and one or more beads formed on each of the shorter frame sides, wherein at least one of the beads formed on each of the longer frame sides has a shape different from a shape of the beads formed on each of the shorter frame sides, to increase a rigidity of the longer frame side.

The at least one bead of each longer frame side, which has the shape different from the shape of the beads formed on each shorter frame side, may have a structure having a plurality of portions with different heights.

The at least one bead of each longer frame side, which has the structure having a plurality of portions with different heights, may be a stepped bead.

The stepped bead of each longer frame side may comprise two layers.

The beads formed on each longer frame side may be arranged such that one bead is arranged at a central portion of the longer frame side, and two beads are arranged at opposite sides of the central portion of the longer frame side, respectively.

The beads arranged at the opposite sides of the central portion of each longer frame side may be stepped beads, respectively.

In accordance with another aspect, the present invention provides a frame for a cathode ray tube comprising a substantially rectangular frame body having longer and shorter sides, and one or more beads formed on each of the longer frame sides, and one or more beads formed on each of the shorter frame sides, wherein the number of the beads formed on each of the longer frame sides is different from the number of the beads formed on each of the shorter frame sides, to increase a rigidity of the longer frame side.

The number of the beads formed on each longer frame side may be greater than the number of the beads formed on each shorter frame side.

BRIEF DESCRIPTION OF THE DRAWINGS

The above objects, and other features and advantages of the present invention will become more apparent after reading the following detailed description when taken in conjunction with the drawings, in which.

DESCRIPTION OF THE PREFERRED EMBODIMENTS

Figure 1:
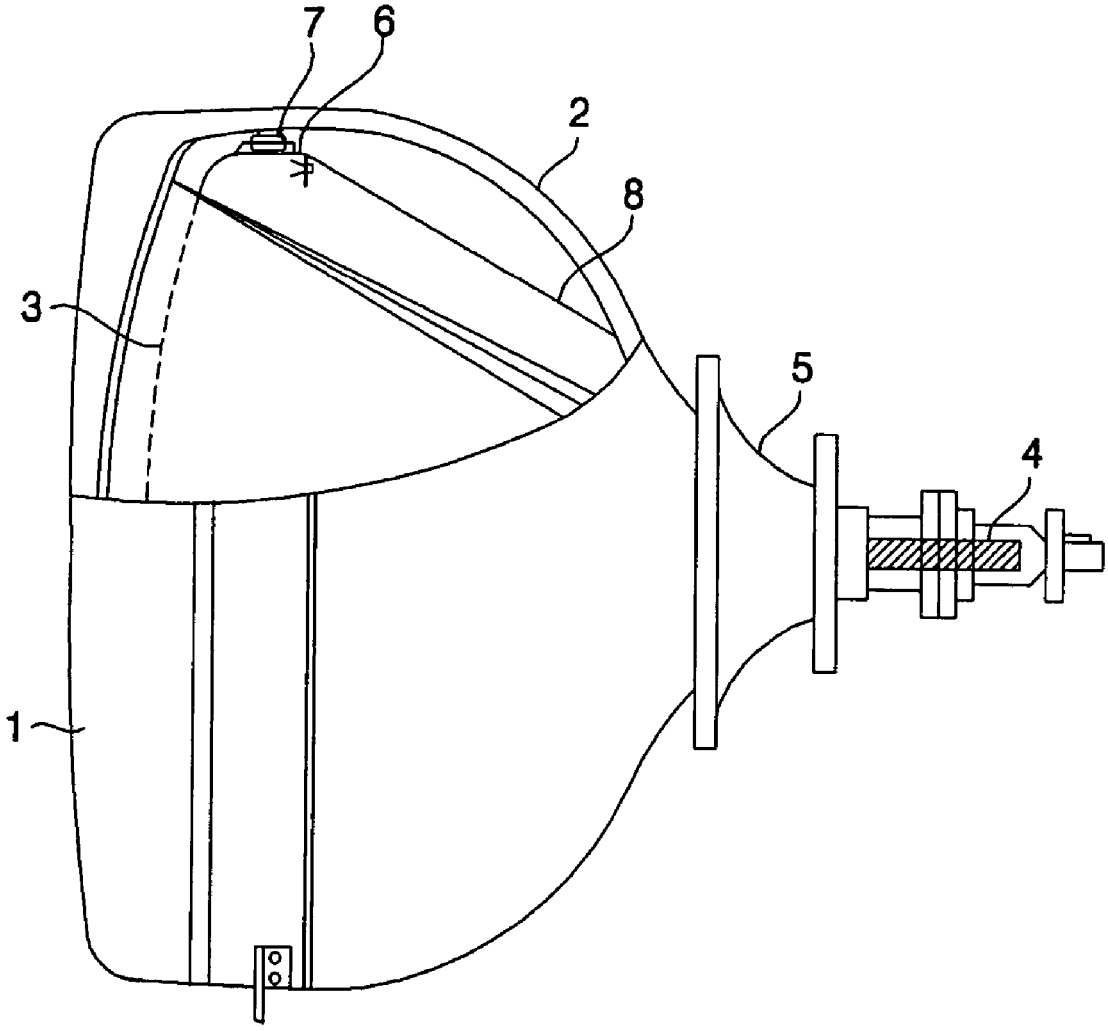
FIG. 1 (Prior Art)
FIG. 1 is a sectional view illustrating a structure of a conventional cathode ray tube.
Figure 2:
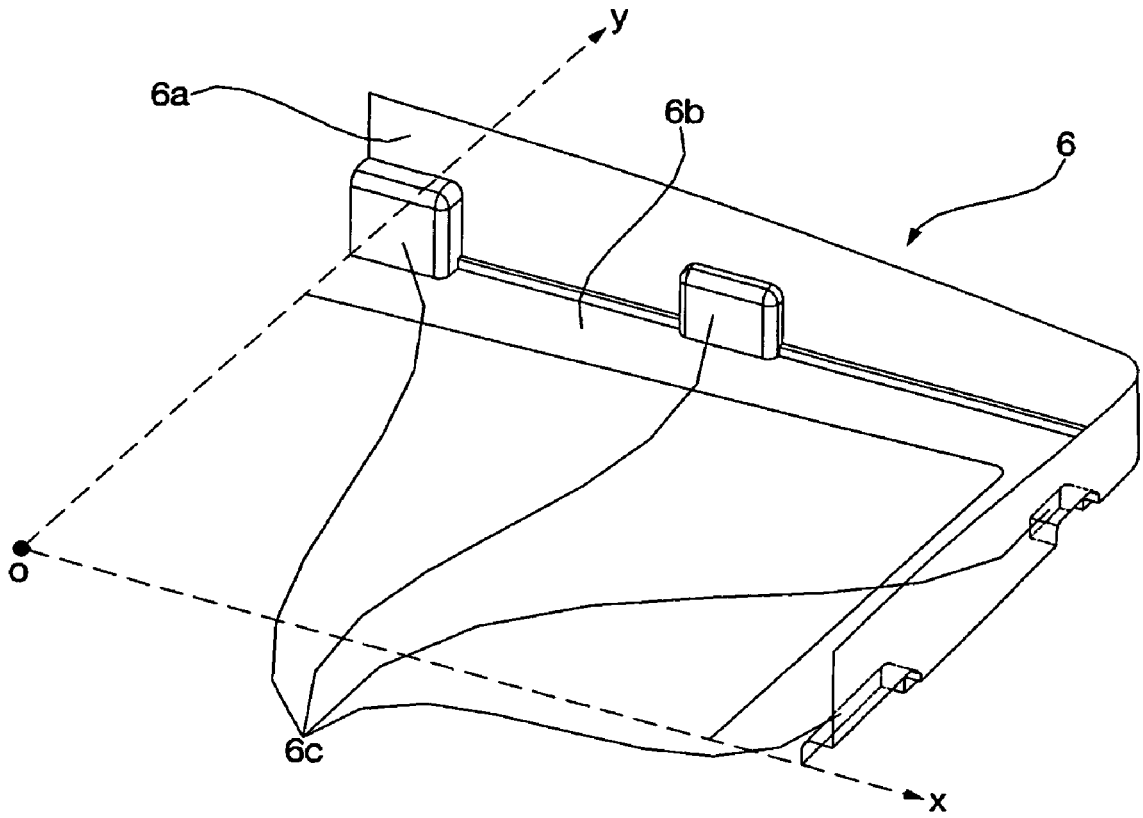
FIG. 2 (Prior Art)
FIG. 2 is a perspective view illustrating a conventional frame, on which beads are formed.

Hereinafter, exemplary embodiments of a cathode ray tube according to the present invention will be described with reference to the annexed drawings. In the following description, the same elements are referred to by the same title and designated by the same reference numeral.

Figure 3:
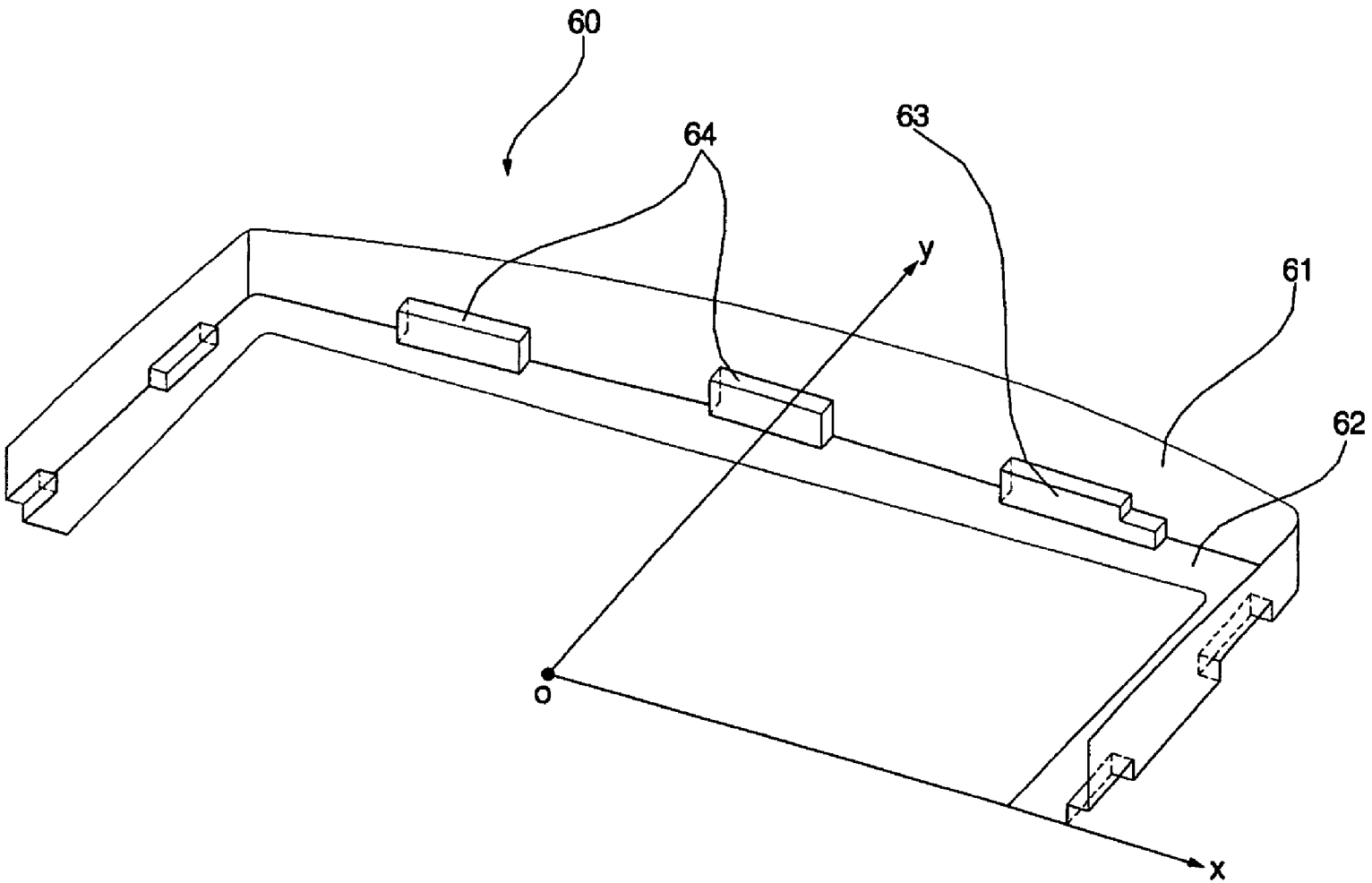
FIG. 3 is a perspective view illustrating a part of a frame for a cathode ray tube according to a first embodiment of the present invention.

FIG. 3 is a perspective view illustrating a part of a frame for a cathode ray tube according to a first embodiment of the present invention. The frame, which is designated by reference numeral 60 in FIG. 3, has a substantially rectangular structure having longer sides extending along a longer axis x and shorter sides extending along a shorter axis y. The frame 6 also has a side wall 61 welded to a shadow mask, and a bottom wall 62 bent from a lower end of the side wall 61 substantially in perpendicular to the side wall 61.

In accordance with the first embodiment of the present invention, Beads are formed on the frame 60 such that the numbers of the beads respectively formed on the longer and shorter sides of the frame 60 are the same. In the case of FIG. 3, the beads on each of the longer and shorter sides of the frame 60 are arranged such that one bead, which has a substantially rectangular shape, is centrally positioned, and two beads are positioned at opposite sides of the central bead, respectively.

In order to reinforce each longer side of the frame 60, at least one of the beads formed on the longer frame side has a shape different from the beads of the shorter frame side. Preferably, the bead of each longer frame side, which has a shape different from the beads of the shorter frame side, has a structure having portions with different heights.

The structure of the longer frame side, which has portions with different heights, may be implemented in the form of a stepped structure. In the case of FIG. 3, one of the beads formed at opposite sides of the central bead on the longer frame side has a stepped structure. In particular, the stepped bead, which is designated by reference numeral 63 in FIG. 3, preferably consists of two layers.

The stepped bead 63 has a structure different from those of the remaining beads 64 formed on the longer frame side and the beads formed on the shorter frame side. For this reason, the bead arrangement on the longer frame side is asymmetrical to the bead arrangement on the shorter frame side.

Figure 5:
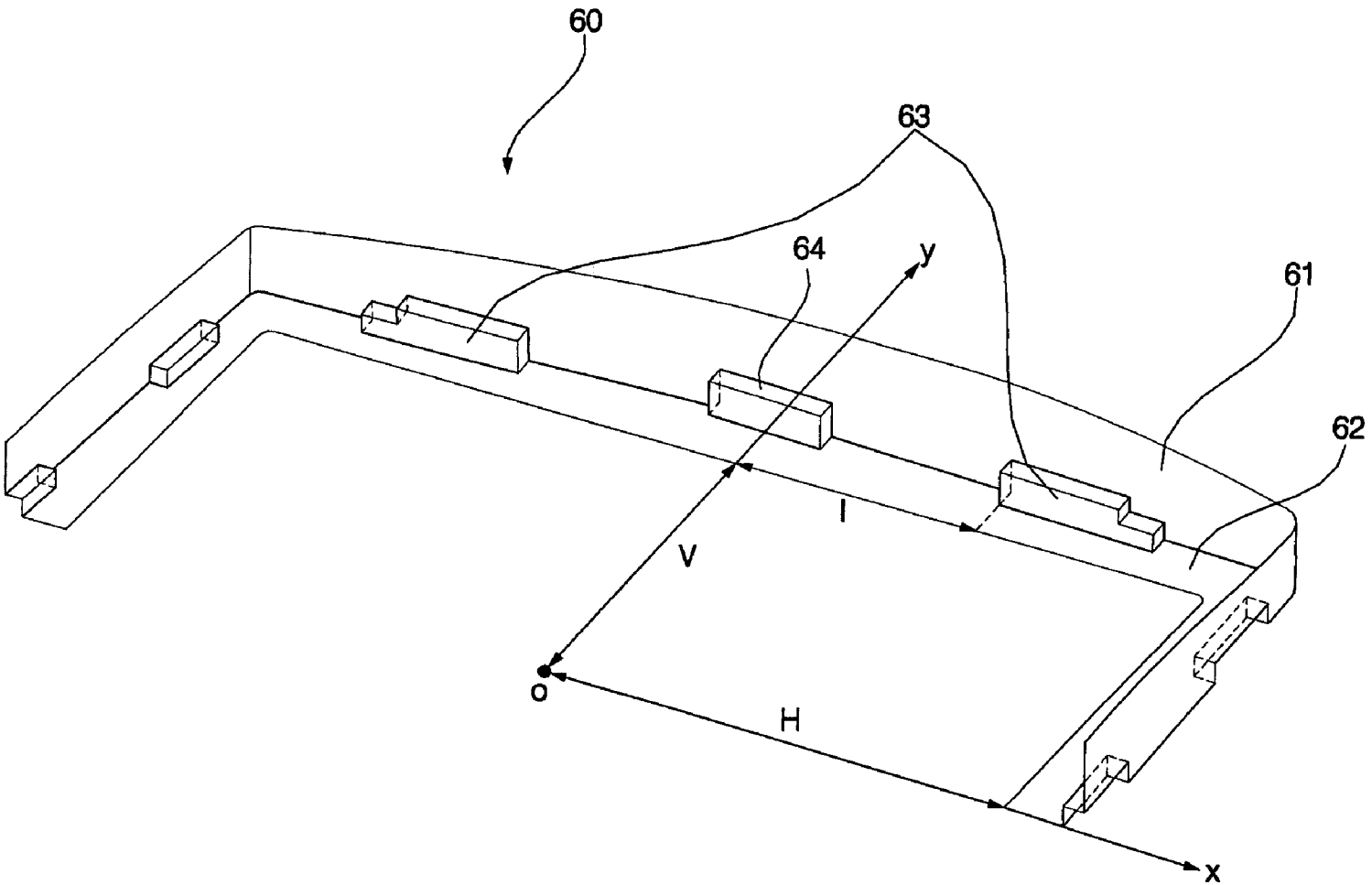
FIG. 5 is a perspective view illustrating a part of a frame with a stepped bead in accordance with the first embodiment of the present invention.

As shown in FIG. 3, an opening is defined by an inner peripheral edge of the bottom wall 62 in the frame 60. Referring to FIG. 5, the distance from the center o of the opening to the inner peripheral edge of the bottom wall 62 along the longer axis x is represented by "H", and the distance from the center o to the inner peripheral edge of the bottom wall 62 along the shorter axis y is represented by "V".

Also, the distance from the center of each longer side of the frame 60 to a leading end of the stepped bead 63 arranged toward the longer frame side center is represented by "I".

Meanwhile, FIGS. 4A to 4D are perspective views each illustrating a bead structure with portions of different heights. As shown in FIGS. 4A to 4D, this bead structure may have various shapes.

Figure 4A:
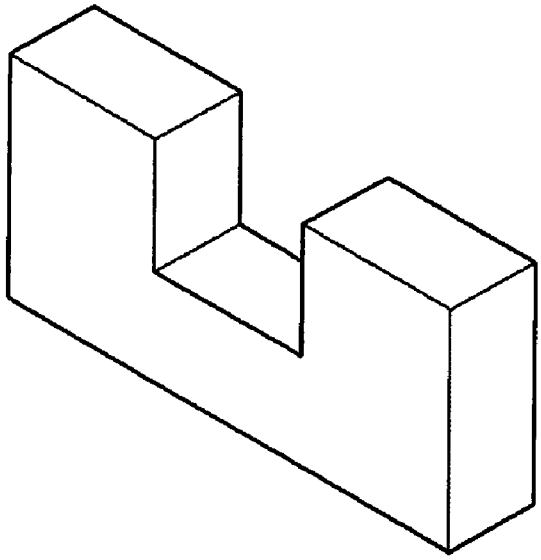
FIGS. 4A to 4D are perspective views each illustrating a bead structure having a plurality of portions with different heights in accordance with the first embodiment of the present invention.
Figure 4B:
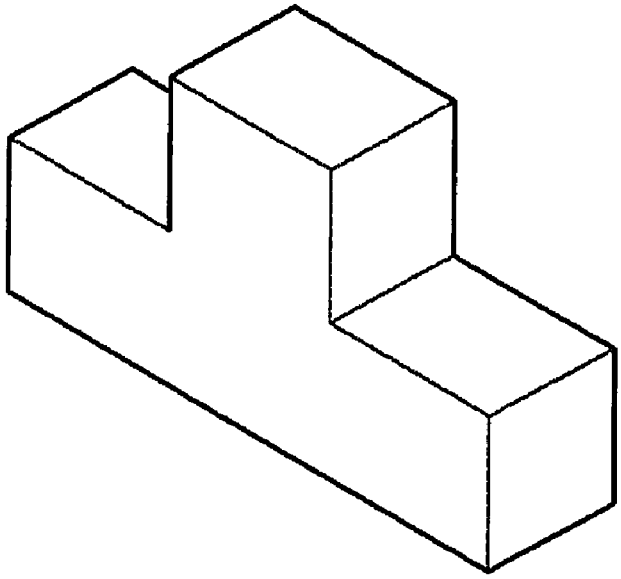

FIG. 4A shows a structure in which the bead has a groove such that layers arranged at opposite sides of the groove have the same height. FIG. 4B shows a structure in which the bead has a protrusion such that layers arranged at opposite sides of the protrusion have the same height.

Figure 4C:
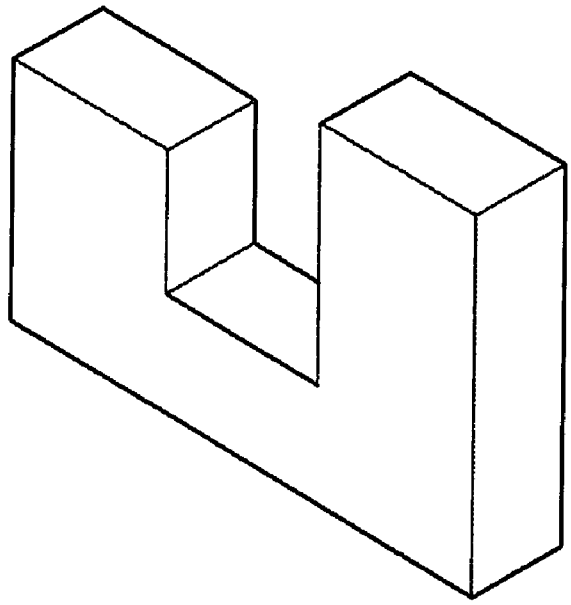
Figure 4D:
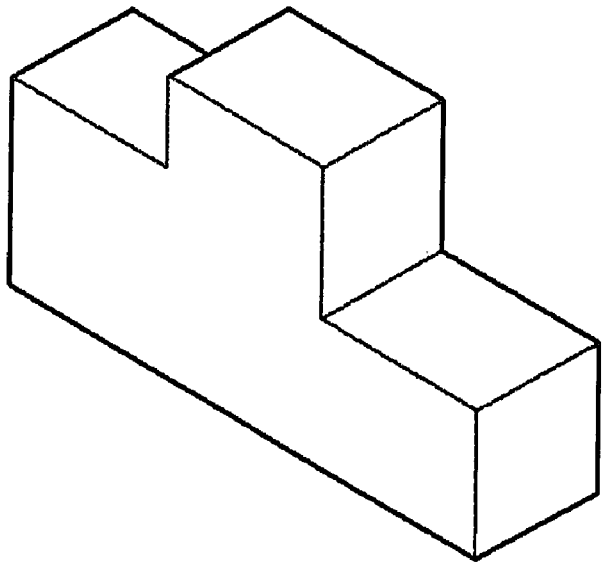

On the other hand, FIG. 4C shows a structure in which the bead has a groove such that layers arranged at opposite sides of the groove have different heights. FIG. 4D shows a structure in which the bead has a protrusion such that layers arranged at opposite sides of the protrusion have different heights.

The stepped bead 63 formed on each longer side of the frame 60 may be replaced by the structure selected from those of FIGS. 4A to 4D.

Figure 6:
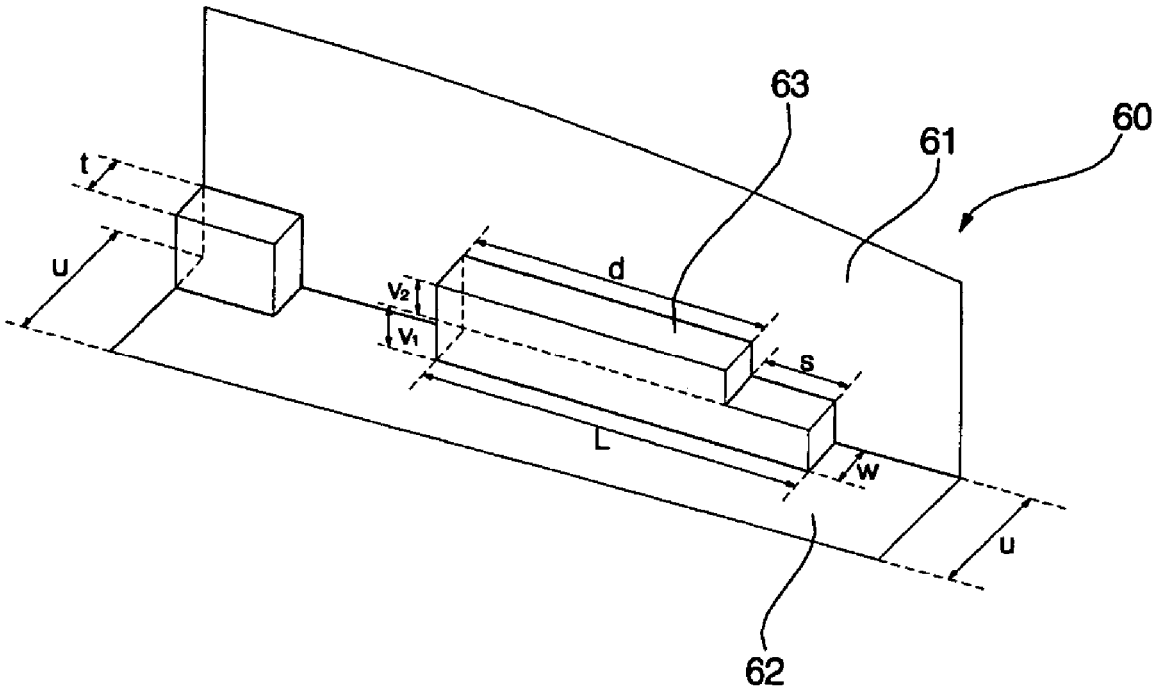
FIG. 6 is a schematic view defining the lengths of portions in the stepped bead.

Meanwhile, FIG. 5 is a perspective view illustrating a part of a frame with a stepped bead. FIG. 6 is a schematic view defining the lengths of portions in the stepped bead.

As shown in FIG. 5, at least one of the beads formed on each longer side of the frame 60 has a structure different from that of the beads formed on each shorter side of the frame 60.

In particular, the structure of the bead on the longer frame side, which is different from that of the beads on the shorter frame side, has a plurality of portions with different heights. Preferably, the bead of the longer frame side, which has a plurality of portions with different heights, has a stepped structure.

In the case of FIG. 5, the stepped bead, which is designated by reference numeral 63, consists of two layers. In this case, one bead is formed at a central portion of each longer frame side, and two beads are formed at opposite sides of the central portion of the longer frame side, respectively.

The beads formed at opposite sides of the central portion of the longer frame side have a stepped structure, so that they are referred to as stepped beads 63. On the other hand, the bead formed at the central portion of the longer frame side and the beads formed on the shorter frame side have a general structure, so that they are referred to as general beads 64.

FIG. 6 is a schematic view defining the dimensions of the stepped bead. The stepped bead shown in FIG. 6 consists of two layers having different heights.

In the stepped bead 63 consisting of two layers, the lower bead layer may be referred to as a "first bead", and the upper bead layer may be referred to as a "second bead".

Referring to FIG. 6, the whole length of the stepped bead 63 is represented by "L", the height of the first bead in the stepped bead 63 is represented by "V1", and the height of the second bead in the stepped bead 63 is represented by "V2".

Also, the length of the second bead in the stepped bead 63 is represented by "d", and the length of the first bead, that is, the length obtained by subtracting the length of the second bead from the whole length of the stepped bead 63, is represented by "s".

Also, the width of the bottom wall of the frame 60 is represented by "u", the width of the stepped bead 63 is represented by "w", and the width of the general bead 64 formed at the central portion of the longer frame side is represented by "t".

The features of the beads formed on the frame 60 will be described hereinafter.

As shown in FIG. 3, the numbers of the beads respectively formed on the longer and shorter sides of the frame 60 are the same. The beads have a substantially rectangular shape.

At least one of the beads formed on the longer frame side has a shape different from the beads of the shorter frame side. In particular, in the case of FIG. 3, the bead of each longer frame side, which has a shape different from the beads of the shorter frame side, is the stepped bead 63, which has a stepped structure.

Thus, the central bead formed on the central portion of each longer side of the frame 60 and one of the beads formed at opposite sides of the central bead on the longer frame side have a substantially rectangular structure, as in general beads. These beads are designated by reference numeral 64. Also, the other one of the beads formed at the opposite sides of the central bead has the form of the stepped bead 63.

In accordance with the above-described bead arrangement, it is possible to reinforce the longer frame sides in terms of rigidity, and thus, to reduce the rigidity difference between the longer and shorter sides of the frame 60. Accordingly, it is possible to prevent the frame 60 from being easily twisted due to a temperature variation or a load applied to the frame 60 at one side of the frame 60 when a stress concentration occurs at the longer sides of the frame 60.

Where the beads formed on the longer frame sides have a structure having a plurality of portions with different heights, it is possible to prevent plastic deformation of the frame 60 caused by an external force, such as a torsion caused by a load applied to the frame 60 at one side of the frame 60, contrary to the case in which the beads formed on the frame 60 have a rectangular cross-sectional structure having a constant height.

The bead structure having a plurality of portions with different heights may have various shapes, as shown in FIGS. 4A to 4D. For example, the bead may have a groove such that layers arranged at opposite sides of the groove have the same height, as shown in FIG. 4A.

Also, the bead may have a protrusion such that layers arranged at opposite sides of the protrusion have the same height, as shown in FIG. 4B.

On the other hand, the bead may have a groove such that layers arranged at opposite sides of the groove have different heights, as shown in FIG. 4C. Also, the bead may have a protrusion such that layers arranged at opposite sides of the protrusion have different heights, as shown in FIG. 4D.

Preferably, the bead may have the form of the stepped bead 63, in order to achieve easy bead formation. Also, where beads are formed at the central portion of each longer side of the frame 60 and at opposite sides of the central portion of the longer frame side, and beads are formed at the central portion of each shorter side of the frame 60 and at opposite sides of the central portion of the shorter frame side, it is preferred that the beads, which are formed at the opposite sides of the central portion of each longer frame side, have the form of the stepped bead 63.

FIG. 5 is a perspective view illustrating the frame 60 having the above-described bead arrangement. As shown in FIG. 5, the frame 60 has stepped beads 63 formed at opposite sides of each longer frame side, and a substantially-rectangular bead 64 formed at the central portion of each longer frame side.

In particular, each stepped bead 63 is characterized in that the stepped bead 63 consists of two layers. Thus, the bead arrangement on the longer frame side is asymmetrical to the bead arrangement on the shorter frame side.

Meanwhile, each stepped bead 63 may be designed to have an optimal structure satisfying certain conditions. This will be described with reference to FIGS. 5 and 6.

FIG. 6 is a schematic view defining the lengths of portions in the stepped bead 63.

The frame 60 is designed to satisfy conditions of $$\text{“}L > \frac{H+V}{V1}\text{” and “}V2 < \frac{3}{2} * V1\text{”},$$

wherein "H" represents the distance from the center o of the opening defined by the inner peripheral edge of the bottom wall to the inner peripheral edge of the bottom wall along the longer axis x in the stepped bead 63 applied to the frame of the present invention, "V" represents the distance from the center o to the inner peripheral edge of the bottom wall along the shorter axis y, "L" represents the whole length of the stepped bead 63, "V1" represents the height of the first bead of the stepped bead 63, and "V2" represents the height of the second bead of the stepped bead 63.

Preferably, the height V1 of the first bead of the stepped bead 63 in the frame 60 satisfies the condition of "5 mm≦V1≦15 mm".

The reason why the stepped bead 63 is formed to satisfy the above-described conditions is that it is possible to increase the rigidity of each longer side of the frame 60 only when the whole length of the stepped bead 63 is not less than a predetermined value. The whole length L of the stepped bead 63 has an allowable lower limit varying depending on the height V1 of the first bead. Where the height V of the first bead is reduced, the lower limit of the whole length L is increased. On the other hand, where the height V of the first bead increases, the lower limit of the whole length L is reduced.

It is also preferred that the heights V1 and V2 of the first and second beads satisfy the condition $$\text{“}V2 < \frac{3}{2} * V1\text{”},$$

in order to confine the ratio of the height V2 to the height V1 within a predetermined range.

Meanwhile, where it is assumed that “I” represents the distance from the center of each longer side of the frame 60 to a leading end of the stepped bead 63 arranged toward the longer frame side center, the frame 60 is configured to satisfy the condition $$\text{“}I > \frac{(L+H) * V1}{2 * V2}\text{”},$$

in order to form the stepped bead 63 on the longer frame side at an appropriate position.

The rigidity of the frame 60 may vary, depending on the length and width of the bead corresponding to each layer in the stepped bead 63. Accordingly, the stepped bead 63 is designed to satisfy conditions of $$\text{“}d > \frac{3}{2} * s\text{” and “}w > \frac{1}{3} * u\text{”},$$

wherein “s” represents the length of the first bead, “d” represents the length of the second bead, “u” represents the width of the bottom wall of the frame 60, and “w” represents the width of the stepped bead 63. In accordance with this design, it is possible to optimize the rigidity of the longer sides of the frame 60.

In particular, it is preferred that the length ratio of the second bead to the first bead in the stepped bead 63 satisfy the condition of $$\text{“}1 \leq \frac{d}{1.5 * s} \leq 2\text{”}.$$

When the length ratio is less than 1, the first bead is excessively short, as compared to the second bead, so that the stepped bead 63 ineffectively exhibits the effect of the stepped structure. The same problem occurs when the length ratio is more than 2 because the second bead is excessively long, as compared to the first bead.

The stepped bead 63 is also designed such that the width of the stepped bead 63 satisfies the condition “1.5<u/w<3”. This is because the function of the stepped bead is ineffectively exhibited.

Meanwhile, the width w of the stepped bead 63 satisfies the condition of “8 mm<w<t” to optimize the rigidity of the frame 60, taking into consideration the width u of the bottom wall of the frame 60 and the width of the bead formed at the central portion of each longer frame side.

In particular, where an increase in rigidity is achieved by an improvement in the shapes of the beads formed on the frame 60 according to the present invention, this rigidity increase may be highly effective in the case in which the frame 60 has a reduced thickness. Where the thickness of the frame 60 exceeds about 0.8 mm, the influence of the beads on the rigidity of the frame 60 is minimal because the frame 60 itself has a high rigidity. However, where the frame 60 has a thickness ranging from 0.2 mm to 0.8 mm, the frame 60 may be plastically deformed due to external impact or a variation in temperature applied to the frame 60. In this case, accordingly, it is necessary to form the above-described beads, in order to increase the rigidity of the frame 60, and thus, to prevent plastic deformation of the frame 60.

To this end, at least one of the beads formed on each longer side of the frame 60 has the form of the stepped bead 63, so as to reduce the rigidity difference between the longer and shorter frame sides. In this case, accordingly, it is possible to minimize the phenomenon that stress is concentrated on the longer frame sides due to an external force applied to the frame 60, and thus, to prevent local plastic deformation of the frame 60.

Meanwhile, in accordance with a second embodiment of the present invention, a frame for a cathode ray tube is provided which has a substantially rectangular structure having longer and shorter sides, and is provided with one or more beads formed on each of the longer and shorter sides. The frame according to the second embodiment of the present invention is characterized in that the number of beads formed on each longer frame side is different from the number of beads formed on each shorter frame side.

Figure 7:
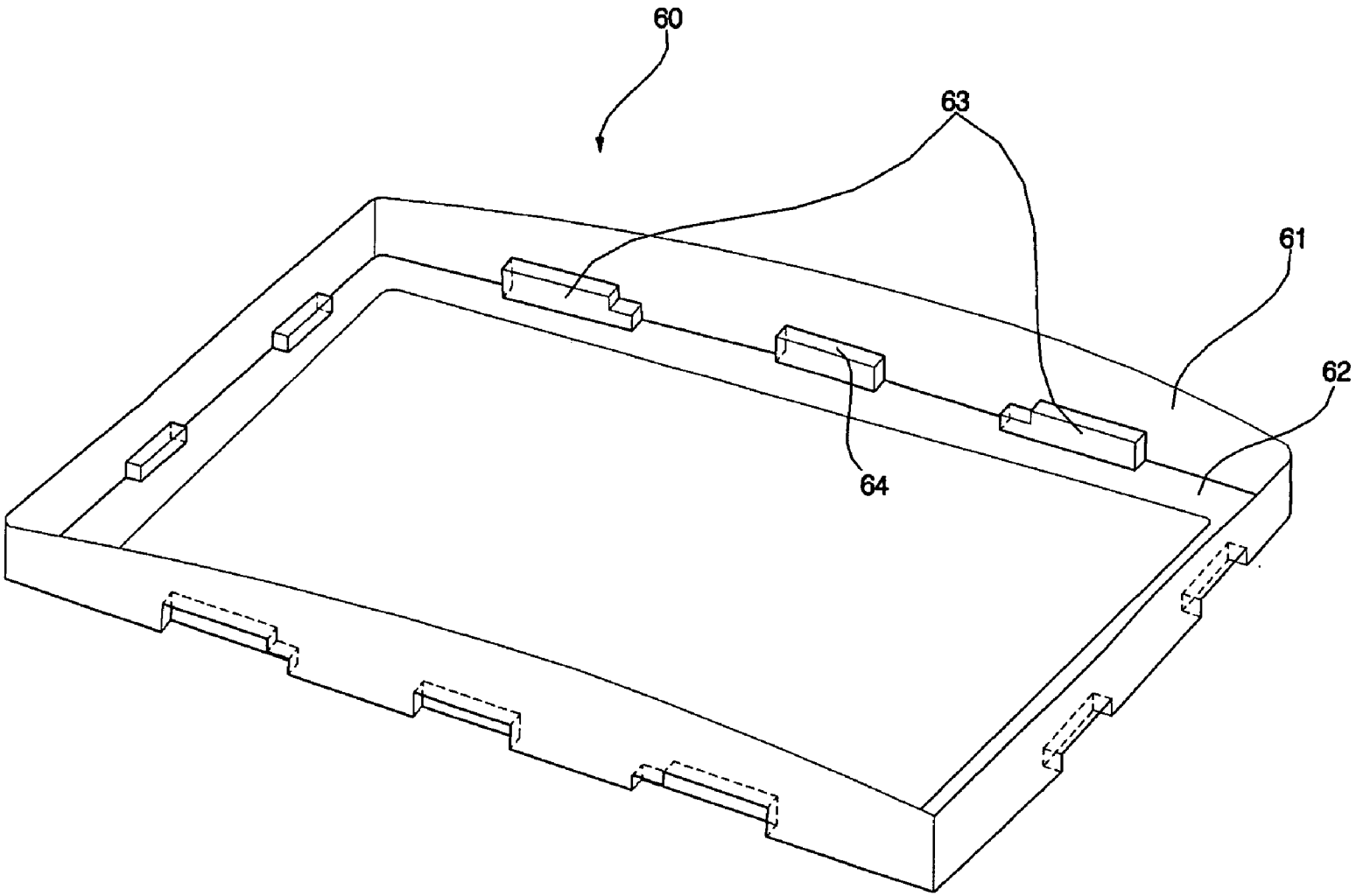
FIG. 7 is a perspective view illustrating the cathode ray tube frame according to the second embodiment of the present invention.

FIG. 7 is a perspective view illustrating the cathode ray tube frame according to the second embodiment of the present invention. As shown in FIG. 7, beads are formed on each longer side of the frame 60 at a central portion of the longer frame side and at opposite sides of the central portion of the longer frame side, respectively. On the other hand, beads are formed on each shorter side of the frame 60 at opposite sides of the shorter frame side. Accordingly, the number of beads formed on each longer frame side is different from the number of beads formed on each shorter frame side.

Various embodiments may be implemented in conjunction with the case in which the number of beads formed on each longer frame side is different from the number of beads formed on each shorter frame side. Preferably, the number of beads formed on each longer frame side is more than the number of beads formed on each shorter frame side.

In this case, it is possible to increase the rigidity of each longer frame side, and thus, to reduce the rigidity difference between the longer and shorter frame sides.

In the case of FIG. 7, three beads are formed on each longer frame side, and two beads are formed on each shorter frame side, so that the rigidity difference between the longer and shorter frame sides is reduced.

In this case, it is preferred that at least one of the beads formed on each longer frame side is different from the beads formed on each shorter frame side, in order to further increase the rigidity of the longer frame side.

As in the first embodiment, the frame according to the second embodiment may have beads having a plurality of portions with different heights. Also, these beads may have a stepped structure. In the case of FIG. 7, the beads, which are formed at the opposite sides of the longer frame side, have the form of a stepped bead 63 with two layers.

The following Table 1 shows a variation in stress and a variation in distortion in a frame when a twisting load is applied to the frame, to compare the frame having stepped beads 63 in accordance with the present invention and a conventional frame having symmetrical beads.

TABLE 1

| Frame | Conventional Frame Model | | Frame Model with Stepped Bead at Longer Side: Case 1 | | Case 2 | | Case 3 | |
|---|---|---|---|---|---|---|---|---|
| Thickness (mm) | Z Dis. (mm) | Stress (Mpa) | Z Dis. (mm) | Stress (Mpa) | Z Dis. (mm) | Stress (Mpa) | Z Dis. (mm) | Stress (Mpa) |
| 0.6 | 0.86 | 247 | 0.93 | 204 | 0.89 | 180 | 0.90 | 180 |
| 0.7 | 0.72 | 206 | 0.79 | 175 | 0.76 | 154 | 0.77 | 154 |
| 0.8 | 0.61 | 175 | 0.69 | 153 | 0.66 | 135 | 0.67 | 135 |
| 0.9 | 0.53 | 153 | 0.61 | 136 | 0.59 | 120 | 0.60 | 120 |
| 1.0 | 0.47 | 135 | 0.54 | 122 | 0.53 | 108 | 0.54 | 108 |

The cases 1 and 3 in Table 1 correspond to frame models wherein the length s of the first bead in the stepped bead is varied in a state in which the length d of the second bead in the stepped bead is fixed. In Table 1, "z dis." and "stress" represent a distortion generated at each frame model in the same direction as a load application, that is, in a z-axis direction, and stress generated at the longer frame side of each frame model when the same load is applied to the frame models.

All distortions described in Table 1 are within an elastic deformation range of frames, so that the distortions do not cause the frame models to be plastically deformed. However, the stresses generated in the frame models may cause the frame models to be plastically deformed.

Referring to Table 1, it can be seen that the frame 60 having the stepped bead 63 formed at each longer frame side exhibits a reduction in stress at each longer frame side, as compared to the conventional frame models having beads with a constant thickness. For example, although stress of 175 Mpa is generated in the conventional frame model having a frame thickness of 0.8 mm, stress of 180 Mpa is generated in the frame model having a frame thickness of 0.6 mm and the bead arrangement according to the present invention. Accordingly, it can be seen that, even when the thickness of the frame 60 is reduced by about 0.2 mm, it is possible to reduce the stress generated at each longer side of the frame 60 to about 97% of the conventional frame model.

Thus, the rigidity of each long side of the frame 60 according to the present invention is increased, so that the rigidity difference between the longer and shorter sides of the frame 60 is reduced, thereby preventing the phenomenon that stress is concentrated on the longer sides of the frame 60. Accordingly, it is possible to effectively prevent the frame 60 from being twisted due to a variation in temperature and a load, even when the frame 60 has a reduced thickness. As a result, an enhancement in productivity is achieved.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

As apparent from the above description, in accordance with the present invention, the rigidity of the longer sides of the frame is increased by forming beads such that the shape of beads formed on the longer frame sides is improved or such that the number of the beads formed on the longer frame sides is different from the number of beads formed on the shorter frame sides. Accordingly, the rigidity and vibration resistance characteristics of the frame against torsion are improved, so that it is possible to prevent the frame from being plastically deformed.

It is also possible to reduce the thickness of the frame, and thus, to reduce the manufacturing cost of the frame.

What is claimed is:

1. A frame for a cathode ray tube comprising a substantially rectangular frame body having longer and shorter sides, and one or more beads formed on each of the longer frame sides, and one or more beads formed on each of the shorter frame sides, wherein the beads formed on each longer frame side are arranged such that one bead is arranged at a central portion of the longer frame side, and two beads are arranged at opposite sides of the central portion of the longer frame side respectively, and;

at least one of the beads formed on each of the longer frame sides has a shape different from a shape of the beads formed on each of the shorter frame sides, to increase a rigidity of the longer frame side, and the at least one bead of each longer frame side is a stepped bead having a structure having a plurality of portions with different heights.

2. The frame according to claim 1, wherein the beads arranged at the opposite sides of the central portion of each longer frame side are stepped beads, respectively.

3. The frame according to claim 2, wherein the frame satisfies the following conditions:

$$L > \frac{H+V}{V1}, \text{ and } V2 < \frac{3}{2} * V1$$

where, "H" represents a distance from a center of an opening defined by a bottom wall of the frame to a peripheral edge of the opening along a longer axis in each stepped bead, "V" represents a distance from the center to the peripheral edge of the opening along a shorter axis, "L" represents a whole length of each stepped bead, "V1" represents a height of the first layer of each stepped bead, and "V2" represents a height of the second layer of each stepped bead.

4. The frame according to claim 3, wherein the height of the first layer of each stepped bead satisfies a condition of "5 mm≦V1≦15 mm".

5. The frame according to claim 3, wherein the frame satisfies the following condition:

$$l > \frac{(L+H)*V1}{2*V2}$$

where, "l" represents a distance from a center of each longer frame side to a leading end of each stepped bead arranged toward the longer frame side center.

6. The frame according to claim 2, wherein the frame satisfies the following conditions:

$$d > \frac{3}{2}*s, \text{ and } w > \frac{1}{3}*u$$

where, "s" represents a length of the first layer of each stepped bead, "d" represents a length of the second layer of each stepped bead, "u" represents a width of the bottom wall of the frame, and "w" represents a width of each stepped bead.

7. The frame according to claim 6, wherein the frame satisfies the following condition:

$$8 \text{ mm} < w < t$$

where, "t" represents a width of the bead formed at the central portion of each longer frame side.

8. The frame according to claim 1, wherein the frame has a thickness of 0.2 mm to 0.8 mm.

9. The frame according to claim 1, wherein the stepped bead of each longer frame side comprises two layers.

10. A frame for a cathode ray tube comprising a substantially rectangular frame body having longer and shorter sides, and one or more beads formed on each of the longer frame sides, and one or more beads formed on each of the shorter frame sides, wherein the beads formed on each longer frame side are arranged such that one bead is arranged at a central portion of the longer frame side, and two beads are arranged at opposite sides of the central portion of the longer frame side, respectively, and;

the number of the beads formed on each of the longer frame sides is different from the number of the beads formed on each of the shorter frame sides, to increase a rigidity of the longer frame side, and at least one bead of each longer frame side is a stepped bead having a structure having a plurality of portions with different heights, and.

11. The frame according to claim 10, wherein the number of the beads formed on each longer frame side is greater than the number of the beads formed on each shorter frame side.

12. The frame according to claim 11, wherein the at least one bead of each longer frame side has a shape different from a shape of the beads formed on each shorter frame side.

13. The frame according to claim 10, wherein the beads arranged at the opposite sides of the central portion of each longer frame side are stepped beads, respectively.

14. The frame according to claim 10, wherein the frame has a thickness of 0.2 mm to 0.8 mm.

15. The frame according to claim 10, wherein the stepped bead of each longer frame side comprises two layers.

* * * * *